US007436133B2

(12) United States Patent
Chou et al.

(10) Patent No.: US 7,436,133 B2
(45) **Date of Patent: *Oct. 14, 2008**

(54) LCD BACK LIGHT PANEL LAMP CONNECTING STRUCTURE

(75) Inventors: Chin-Wen Chou, Hsin-Tien (TW); Eddie Cheng, Hsin-Tien (TW)

(73) Assignee: Zippy Technology Corp., Taiepei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/197,444

(22) Filed: Aug. 5, 2005

(65) Prior Publication Data

US 2005/0269976 A1 Dec. 8, 2005

Related U.S. Application Data

(63) Continuation-in-part of application No. 10/359,182, filed on Feb. 6, 2003, now Pat. No. 6,949,890.

(51) Int. Cl.
*H05B 37/00* (2006.01)
*H05B 41/16* (2006.01)

(52) U.S. Cl. ..... 315/324; 315/254

(58) Field of Classification Search ..... 315/160, 315/161, 291, 312, 324, 246, 250, 254, 255, 315/276, 277; 345/102; 362/559, 561, 225, 362/227

See application file for complete search history.

(56) References Cited

U.S. PATENT DOCUMENTS 5,998,936 A 12/1999 Nilssen ..... 315/209 P
6,278,226 B1 8/2001 Danov et al. ..... 310/359
6,534,934 B1 3/2003 Lin et al. ..... 315/312
6,570,344 B2 5/2003 Lin ..... 315/224
7,067,991 B2 * 6/2006 Hsu et al. ..... 315/224
2003/0035283 A1 2/2003 Lim ..... 362/97
2003/0178951 A1 9/2003 Park et al. ..... 315/312
2004/0119418 A1 6/2004 Moon ..... 315/169.3
2004/0125071 A1 * 7/2004 Kim et al. ..... 345/102
2005/0007333 A1 * 1/2005 Han et al. ..... 345/102
2005/0030277 A1 * 2/2005 Yoo et al. ..... 345/102
2005/0218827 A1 * 10/2005 Ushijima et al. ..... 315/224

FOREIGN PATENT DOCUMENTS

JP 09-193423 A 7/1997
JP 2000-338487 A 12/2000

* cited by examiner

*Primary Examiner*—Thuy Vinh Tran
(74) *Attorney, Agent, or Firm*—Muncy, Geissler, Olds & Lowe PLLC

(57) ABSTRACT

An improved LCD back light panel lamp connecting structure comprises cold cathode fluorescent lamps (CCFL), and adjacent CCFL modules having high voltage ends and feedback ends arranged alternately, and the feedback ends on both sides of the CCFLs respectively coupled to two return boards. The feedback end of the CCFL is coupled to a proximate return board, and the return board is disposed separately at both ends of the CCFLs. Two return boards are coupled to a pulse width modulation (PWM) control unit so that the two return boards feed back the current to the PWM control unit. The high voltage end of the CCFL is coupled to a transformer.

3 Claims, 5 Drawing Sheets

LCD BACK LIGHT PANEL LAMP CONNECTING STRUCTURE

This is a continuation-in-part application, and claims priority, of from U.S. patent application Ser. No. 10/359,182 filed on Feb. 06, 2003, entitled "LCD back light panel lamp connecting structure", which is now U.S. Pat. No. 6,949,890.

FIELD OF INVENTION

The present invention relates to an improved LCD back light panel lamp connecting structure, more particularly to cold cathode fluorescent lamps (CCFL), and adjacent CCFLs modules having its high voltage end and feedback end arranged alternately.

BACKGROUND OF THE INVENTION

A traditional LCD TV or touch screen of a LCD display requires a high brightness to compensate the visual requirements. In general, a cold cathode fluorescent lamp (CCFL) is lit by high voltage; the larger the current, the brighter is the lamp. Therefore several CCFL lamps are generally used to compensate the brightness and evenness, and it is the most important issue is to keep the current of the lamp even and minimize the error. The installation of several sets of loading also increases the number of control units for the lighting and the area of the circuit board, and thus making the manufacturing more complicated and the cost higher. In FIG. 1, it shows a driving device that lights up a CCFL, and comprises a power supply unit 13, a pulse width modulation (PWM) control unit 14, a driving unit 15, a transformer 11, and a loaded cold cathode florescent lamp (FFCL) 12. When the input of the input voltage is initialized, the driving unit 15 immediately drives the transformer 11 to light up the CCFL 12 by the negative/positive voltage effect and the PWM control 14 detects the current of the CCFL lamp 12 through the current feedback 16 and outputs a resonant frequency. The average current of the CCFL lamp 12 can be controlled by means of the driving unit 15 and the transformer 11. Therefore, the light produced can be projected onto the back light panel of the LCD.

Please refer to FIG. 2 for the schematic circuit diagram of a plurality of lamps in accordance with a prior art. In the figure, the high voltage ends of a plurality of lamps 21 respectively connect to a connector 221 and a connector of a transformer 23, and the plurality of transformers 23 are integrated to a circuit board 26 to form an inverter 20, and the feedback end of the plurality of lamps 21 are mutually coupled and connected to the PWM control unit 25, so that the PWM control unit 25 can detect the current of the lamp 21 through the current feedback to output a resonant frequency and control the average current of the CCFL lamp 12.

However, the connection method of the CCFL lamps described above has the following shortcomings:

1. Firstly, the feedback end of the prior-art multiple lamps generally makes the wiring job more complicated, not only increasing the size of the circuit board, but also making the manufacturing complicated, increasing the cost, and unnecessarily consuming higher voltage.
2. Secondly, since the high voltage ends of the cold cathode fluorescent lamps are installed on the same side of the lamp, therefore when the lamp is lit, the temperature at that side is usually too high and thus affecting the life of the lamp.
3. Thirdly, when several lamps are used to compensate the brightness and evenness, it generally causes uneven current and brightness between the lamps since there generally exists a discrepancy between lamps for their production. Thus, it becomes an issue of selecting lamps, or it may require more lamps to improve the brightness and evenness. Such arrangement will increase the cost, and make the manufacture more complicated and the adjustment more difficult.

SUMMARY OF THE INVENTION

The primary objective of the present invention is to overcome the shortcomings and avoid the deficiencies of the prior art. The present invention alternately arranges the high voltage end and the feedback end of adjacent cold cathode fluorescent lamp (CCFL) modules to save wire materials, average the current of the lamp, and enhance the stability of the current.

To achieve the above objective, the improved LCD back light panel lamp connection structure of the present invention comprises cold cathode fluorescent lamps (CCFL), and adjacent CCFL modules having their high voltage end and feedback end arranged alternately, and the feedback end is coupled to a proximate return board and the return board is disposed separately on both sides of the CCFL. Such two return boards are coupled to a pulse width modulation (PWM) control unit, so that the two return boards feed back the current to the PWM control unit. The high voltage end of the CCFL respectively couples to a transformer and drives the transformer to light up several sets of cold cathode fluorescent lamps, and the feedback end of the plurality of CCFLs feeds back the current through the two return boards to a PWM control unit. Such PWM control unit detects the current of the lamp to output a resonant frequency and control the average current of the several sets of CCFLs.

DETAILED DESCRIPTION OF THE PREFERRED EMBODIMENTS

Figure 1:
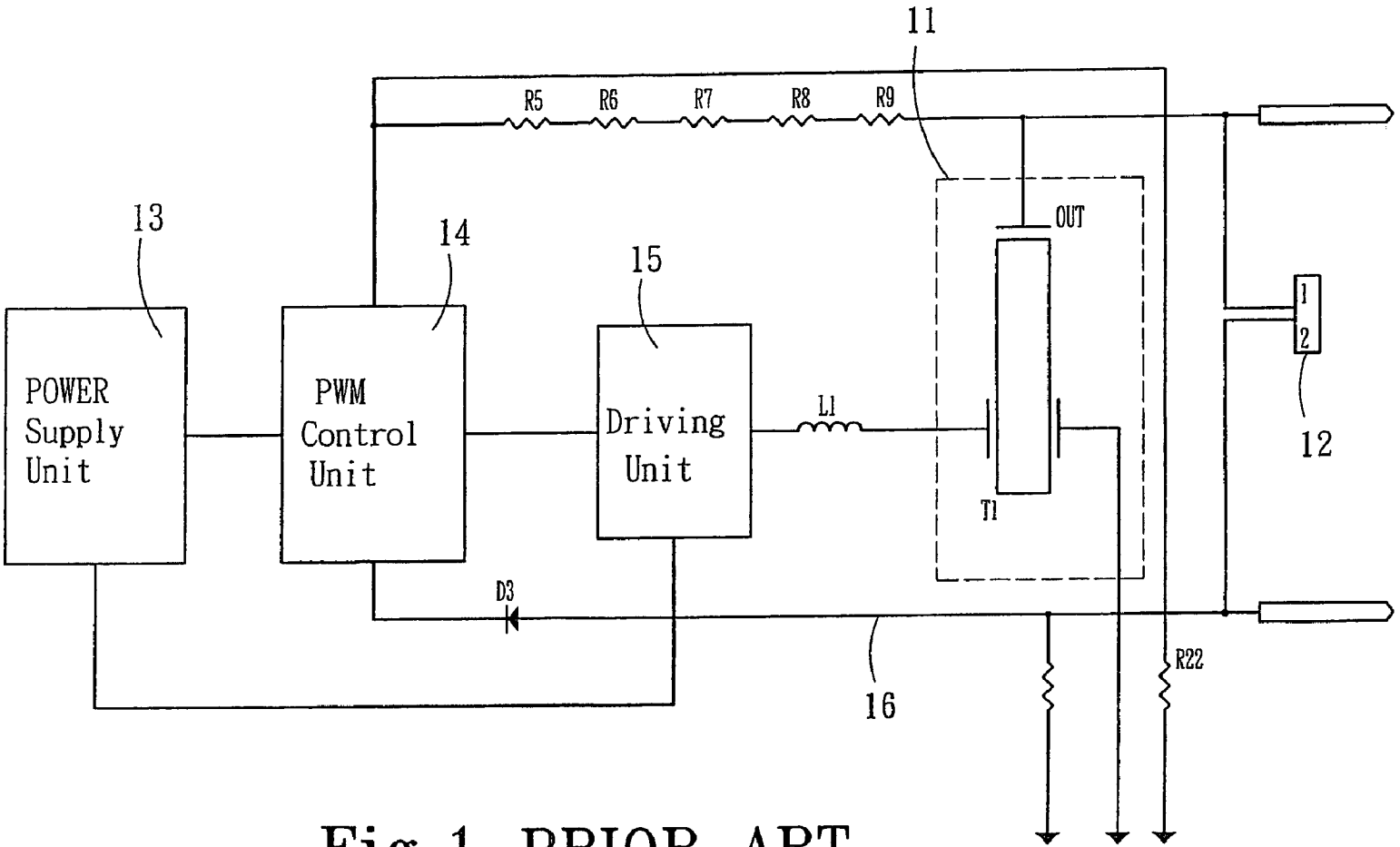
Fig.1 PRIOR ART
FIG. 1 is a schematic circuit diagram of a prior-art cold cathode fluorescent lamp.
Figure 2:
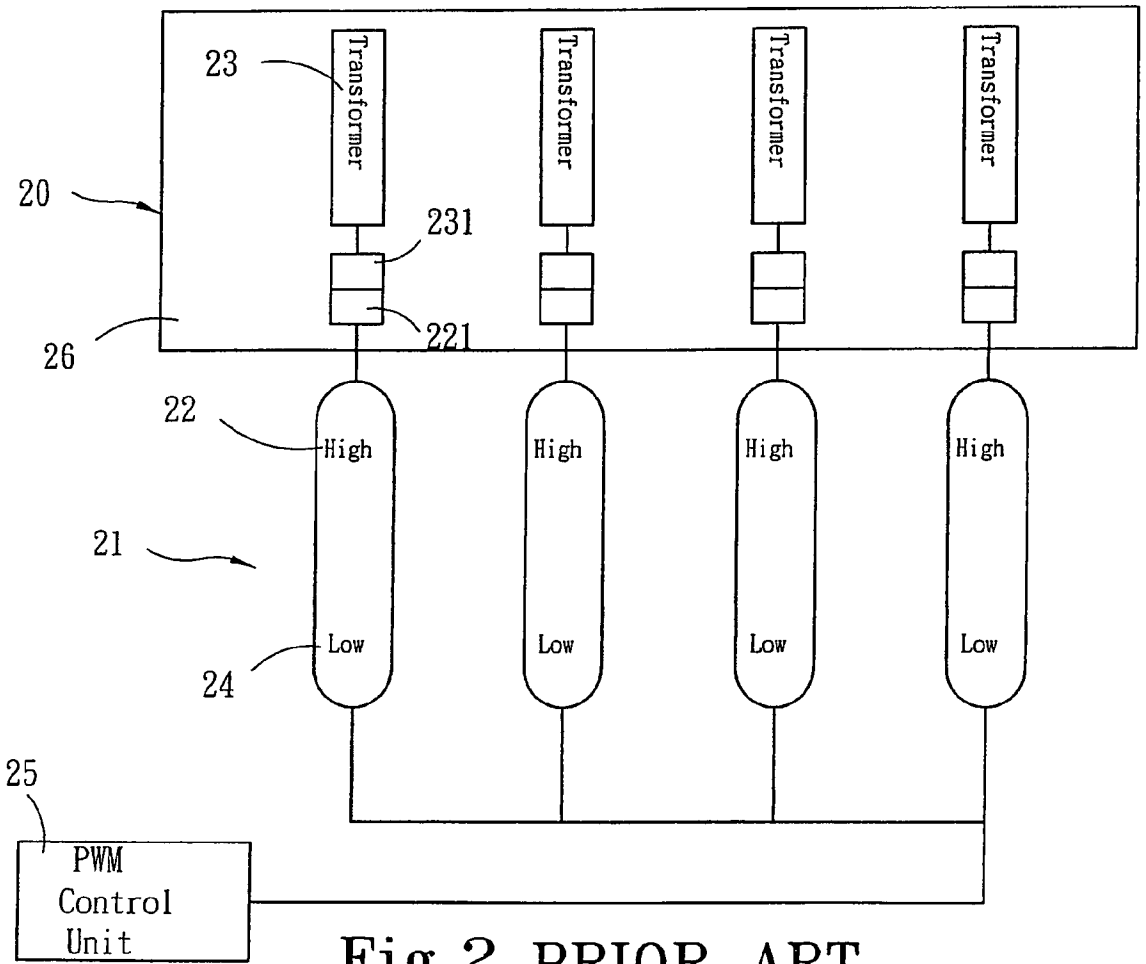
Fig.2 PRIOR ART
FIG. 2 is schematic circuit diagram of a multiple of prior-art lamps.
Figure 3:
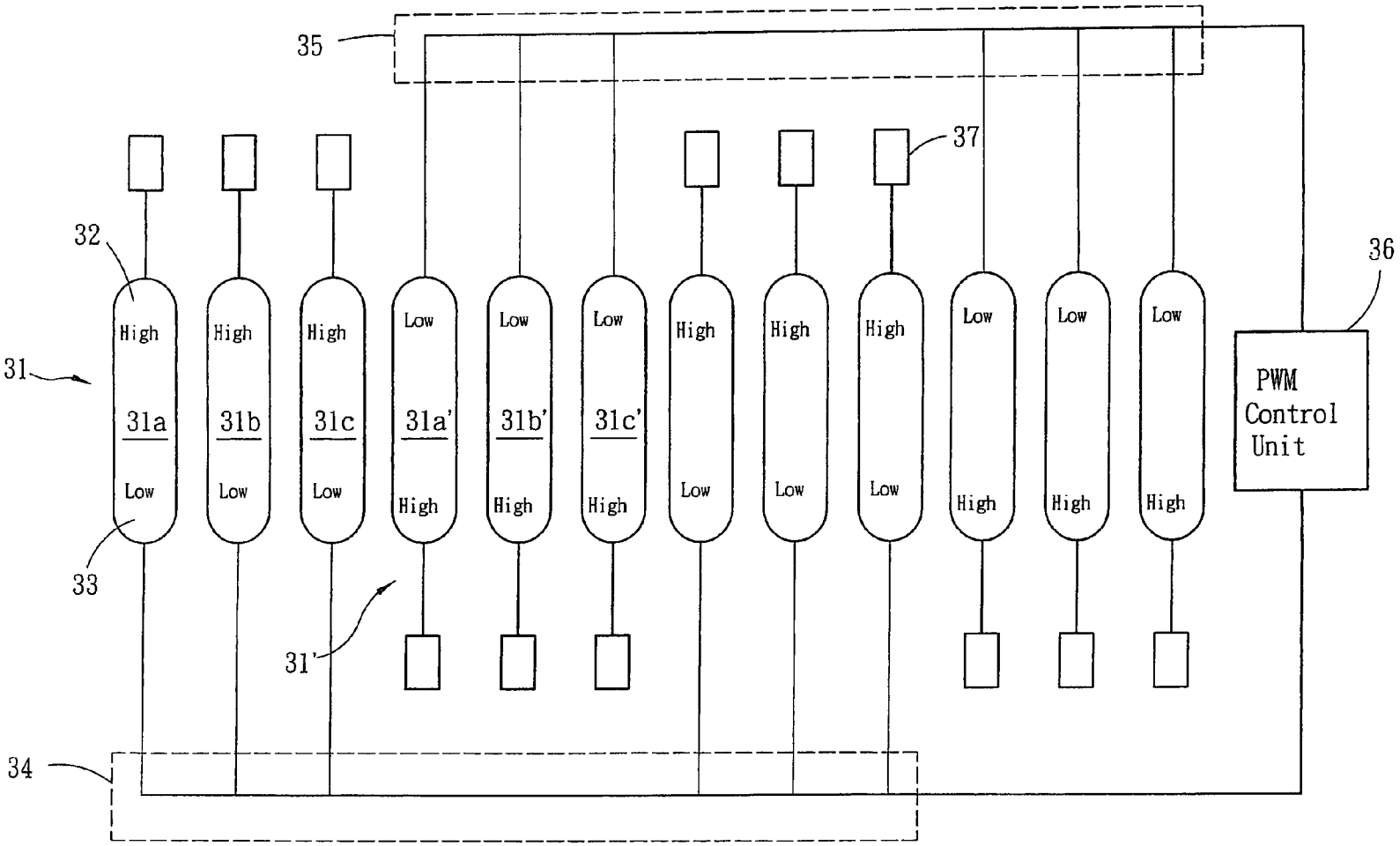
FIG. 3 is a block diagram of the circuit of the present invention.
Figure 4:
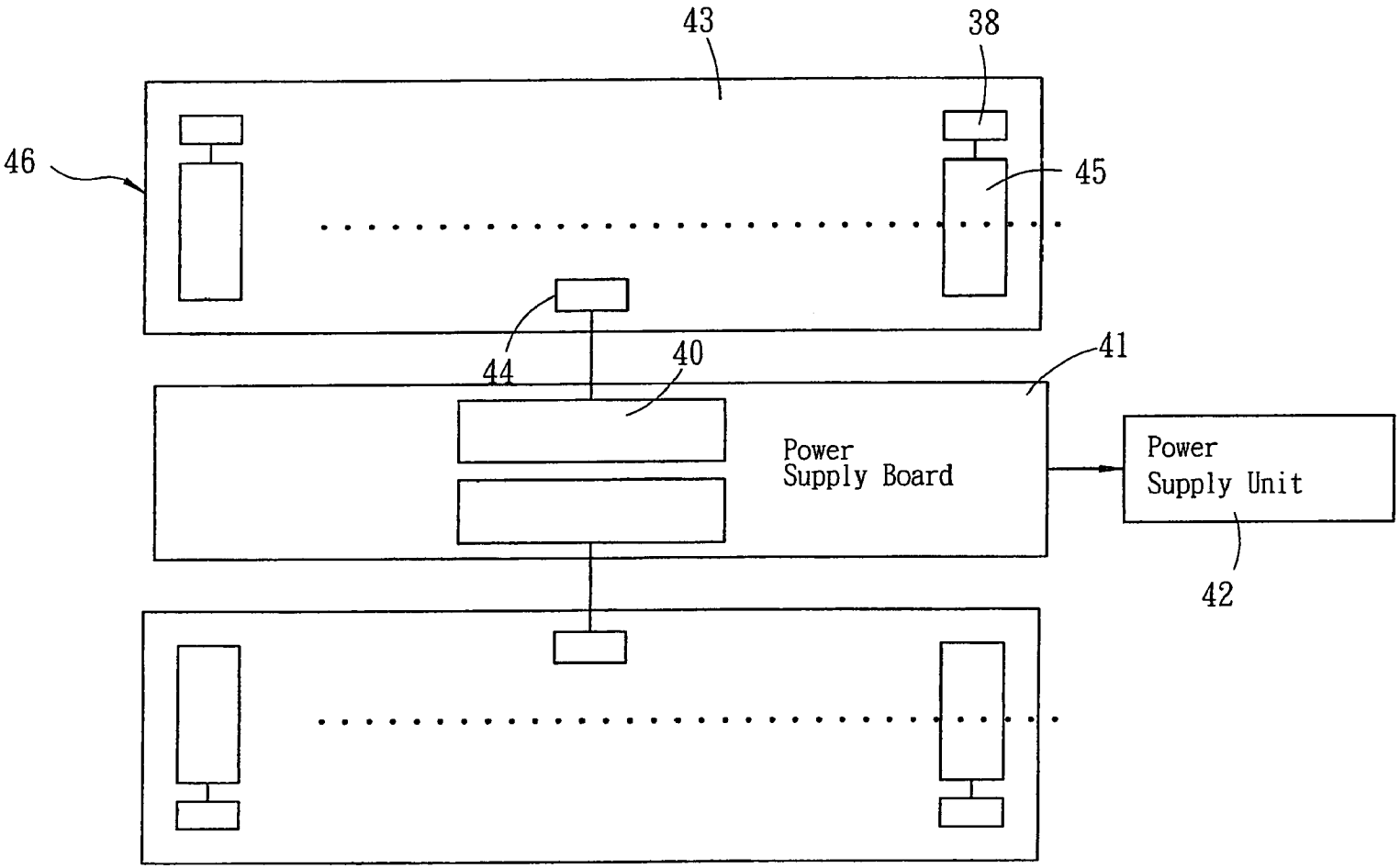
FIG. 4 is a schematic diagram of the transformer and power supply board of the present invention.

Please refer to FIGS. 3 and 4 for the block diagram of the circuit and the schematic diagram of the transformer and power supply board of the present invention respectively. In the figures, the improved LCD back light panel lamp connecting structure comprises cold cathode fluorescent lamps (CCFL) 31, and a plurality of CCFLs 31*a*, 31*b*, 31*c* and 31*a*', 31*b*', 31*c*' comprise a module respectively such that a high voltage end 32 of the CCFL modules 31, 31' is coupled to a first voltage end, and a feedback end 33 is coupled to a second voltage end, and the lamps are arranged in parallel in a first direction forming a row in a second direction perpendicular to the first second direction. High voltage ends 32 and feedback ends 33 of the adjacent CCFL modules 31, 31' are arranged alternately, and the feedback ends 33 on both sides of the adjacent CCFL modules 31, 31' respectively coupled to two return boards 34, 35. Such two return boards 34, 35 are coupled to a pulse width modulation (PWM) control unit 36, so that the two return boards 34, 35 feed back the current to the PWM control unit 36; the high voltage end 32 of the CCFL modules 31, 31' couples to a connector 38 at an output end of a transformer 45 by a connector 37; the feedback ends 33 of the CCFL modules 31, 31' mutually couple to the two return boards 34, 35; the transformer comprises at least one transformer or ceramic transformer being coupled to the connector 37 of the CCFL modules 31, 31' by a connector 38, and each transformer 45 is integrated on a circuit board 43 to form a inverter 46, and then connected to a connector 40 on a power supply board 41 by a connector 44 on the circuit board 43. The power supply board 41 is coupled to a power supply unit 42 so that the power can be supplies to each transformer 45 on the inverter 46 via the power supply board 41, which can save wire materials and simplify the structure.

Figure 5:
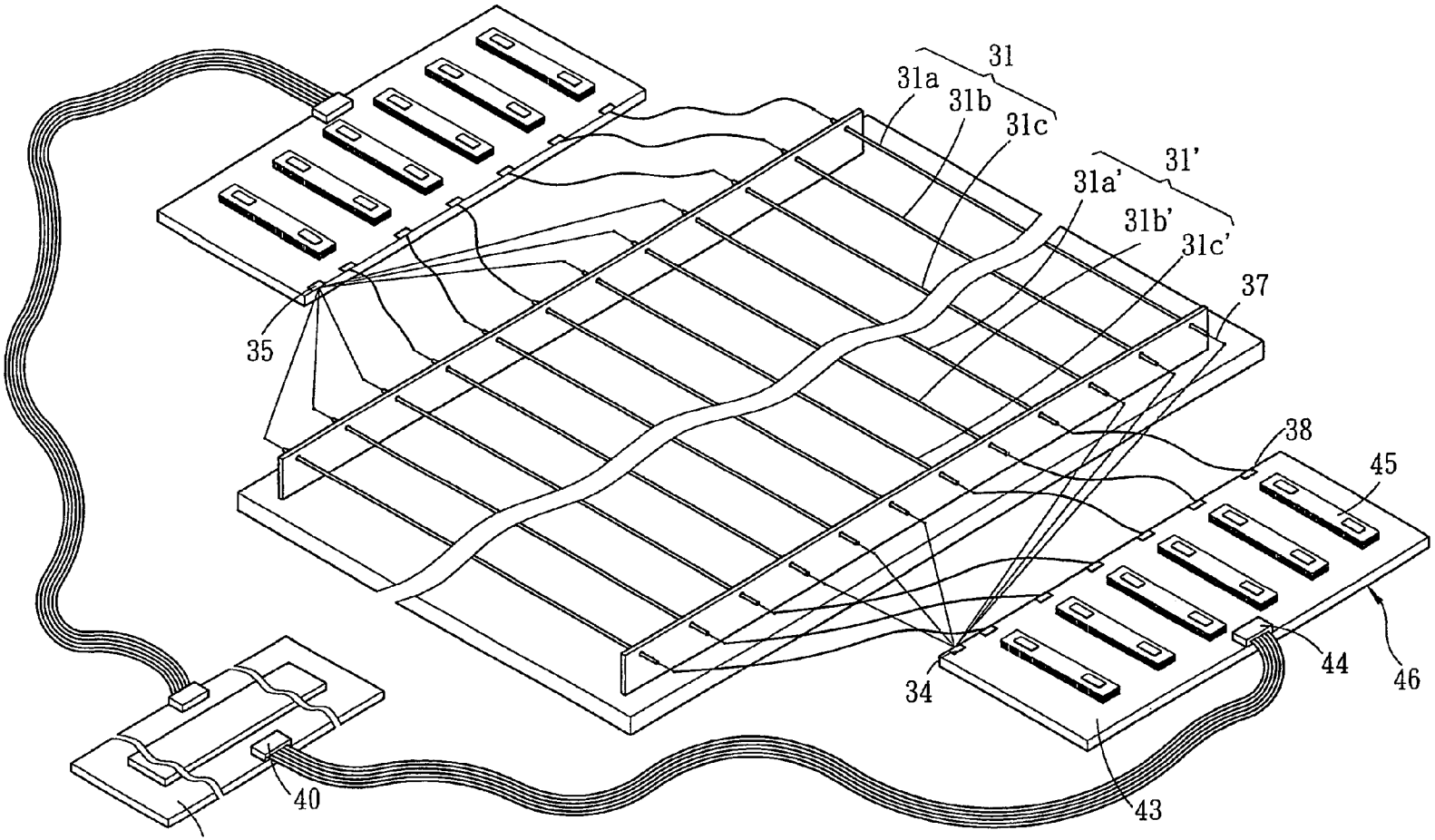
FIG. 5 is a schematic diagram of an improved LCD back light panel lamp connecting structure according to a preferred embodiment of the present invention.

Referring to FIGS. 3 and 5 for the CCFL modules 31, 31', three cold cathode fluorescent lamps 31*a*, 31*b*, 31*c* are grouped as a module and three CCFLs 31*a'*, 31*b'*, 31*c'* are grouped as another module, the high voltage ends 32 and the feedback ends 33 of adjacent CCFL modules 31, 31' are arranged alternately according to a preferred embodiment of the invention.

The drive transformer 45 drives the plurality of CCFL modules 31, 31' to light up and the feedback end 33 of each CCFL module 31, 31' feeds back the current to the PWM control unit 36 through the two return boards 34, 35, and the PWM control unit 36 detects the current of the CCFL modules 31, 31' to output a resonant frequency, and control the average current of several adjacent CCFL modules 31, 31'.

In view of the description above, the present invention definitely overcomes the shortcomings of the prior art and has the following advantages:

1. The present invention arranges the adjacent CCFL modules alternately, such that the high voltage ends of the lamps are arranged alternately, and thus will not overheat one side of the lamp when the lamp is lit.
2. The feedback ends of several lamps of the present invention are connected in series, and all coupled to the two return boards, not only saving wire material, lowering the consumption of voltage for transmission, and increasing the stability of the circuit, but also making the manufacture easy and the cost lower.
3. The present invention arranges the high voltage end and the feedback end of several lamps alternately, so that the current of each CCFL can be more evenly distributed, and thus achieving the purpose of even lighting.

While the invention has been described by way of example and in terms of a preferred embodiment, it is to be understood that the invention is not limited thereto. To the contrary, it is intended to cover vanous modifications and similar arrangements and procedures, and the scope of the appended claims therefore should be accorded the broadest interpretation so as to encompass all such modifications and similar arrangements and procedures.

What is claimed is:

1. An improved LCD back light panel lamp connection structure, comprising:

a plurality of cold cathode fluorescent lamps grouped into modules, with each module having a plurality of physically adjacent lamps, where physically adjacent lamps have no intervening lamps of other modules located therebetween, each of said lamps having a high voltage end at a first voltage and a feedback end at a second voltage, said lamps being arranged in parallel in a first direction forming a row in a second direction perpendicular to the first direction, the lamps in a given module having high voltage ends on the same side of the row, the high voltage ends and the feedback ends of adjacent modules being reversed, so that ends of modules on each side of said row alternate between high voltage ends and feedback ends; and return boards provided on opposite sides of said row, each return board being connected to feedback ends of half of the modules which are closer to the return board than the other half of the modules, and the return boards being connected to first and second terminals of a PWM control unit.

2. The improved LCD back light panel lamp connection structure of claim 1, wherein light from the 1amps is evenly distributed between the high voltage ends and the feedback ends.

3. The improved LCD back light panel lamp connection structure of claim 1, wherein heat is distributed evenly between the high voltage ends and the feedback ends.

* * * * *